US007751581B2

(12) United States Patent
Heil

(10) Patent No.: US 7,751,581 B2
(45) Date of Patent: Jul. 6, 2010

(54) PUBLIC ADDRESS SYSTEM WITH ADJUSTABLE DIRECTIVITY

(75) Inventor: Christian Heil, Gometz la Ville (FR)

(73) Assignee: L-Acoustics, Marcoussis (FR)

( * ) Notice: Subject to any disclaimer, the term of this patent is extended or adjusted under 35 U.S.C. 154(b) by 1191 days.

(21) Appl. No.: 11/225,384

(22) Filed: Sep. 13, 2005

(65) Prior Publication Data

US 2006/0062402 A1 Mar. 23, 2006

(30) Foreign Application Priority Data

Sep. 13, 2004 (FR) ..... 04 09688

(51) Int. Cl.
*H04R 1/20* (2006.01)

(52) U.S. Cl. ..... 381/337; 381/338; 381/339; 381/341; 381/342

(58) Field of Classification Search ..... 381/82, 381/335, 182, 337–343
See application file for complete search history.

(56) References Cited

U.S. PATENT DOCUMENTS 5,020,630 A 6/1991 Gunness
5,163,167 A 11/1992 Heil
5,590,214 A * 12/1996 Nakamura ..... 381/182
6,394,223 B1 * 5/2002 Lehman ..... 181/152
6,628,796 B2 * 9/2003 Adamson ..... 381/342
2002/0106097 A1 * 8/2002 Danley et al. ..... 381/345
2004/0131217 A1 7/2004 Opie et al.

FOREIGN PATENT DOCUMENTS

GB 404937 1/1934

* cited by examiner

*Primary Examiner*—Vivian Chin
*Assistant Examiner*—Paul Kim
(74) *Attorney, Agent, or Firm*—Bachman & LaPointe, P.C.

(57) ABSTRACT

The invention relates to a public address system including one or more loudspeakers, each of which is in particular equipped with a section for reproducing high-frequency sounds, including a wave expansion guide, which receives, at its input sound waves coming from a transducer and having, projecting in a plane, a form opening outwards from its input to its output for distributing, in a solid transmission angle, the sound waves coming from the expansion guide. According to the invention, the expansion guide includes one or more mobile flaps that can be moved by a movement made parallel to the plane, so as to enable the solid transmission angle of the sound waves to be adjusted.

10 Claims, 6 Drawing Sheets

PUBLIC ADDRESS SYSTEM WITH ADJUSTABLE DIRECTIVITY

BACKGROUND OF THE INVENTION (1) Field of the Invention

This invention relates in general to public address techniques.

More specifically, the invention relates to a public address system consisting of at least one first loudspeaker enclosure equipped with at least one section for reproducing high-frequency sounds, which high-frequency sound section includes at least one transducer and a wave expansion guide, which has an input and an output relatively close and relatively far, respectively, from the transducer, and which receives, at its input, the sound waves from the transducer, and has, at least projecting in a first plane, a form opening outwards from its input to its output for distributing, in a solid transmission angle, the sound waves coming from said expansion guide.

(2) Prior Art

Systems of this type are well known to a person skilled in the art.

One of the major problems raised by a public address systems lies in the difficulty of clearly restoring, in particular in a closed space such as an auditorium, sounds typically located in the range of 300 Hz to 20 kHz, and in particular high-frequency sounds located in the range of 1300 Hz to 20 kHz.

Indeed, insofar as, unlike low-frequency sounds, i.e. sounds with a frequency typically below 300 Hz, high or medium frequency sounds have a relatively small wavelength. These sounds are most capable of being reflected and recombining, forming multiple interferences and acoustic delays that adversely affect the quality of its reproduction.

SUMMARY OF THE INVENTION

The aim of the invention, which is based in this context, is to propose a public address system with a sound quality substantially superior to that of the existing systems.

To this end, the system of the invention, which is consistent with the general definition given above, is essentially characterised in that the expansion guide of the first loudspeaker includes at least one first mobile flap that can be moved by a movement made parallel to the first plane, with said solid transmission angle thus having a value that makes it capable of being adjusted by the movement of this first flap.

"Movement made parallel to the first plane" in this case means, for example, a movement along the arc of a circle parallel to the first plane and therefore producing a rotation of the first flap about an axis at least substantially perpendicular to this first plane, or a movement along a straight line segment parallel to the first plane and therefore producing a translation of the first flap with respect to its initial position.

Owing to this arrangement, which gives the first loudspeaker adjustable directivity, it is possible to concentrate, in a solid adjustable angle, the energy of the sound waves coming from the expansion guide and thus to prevent these waves from uselessly hitting the walls of the acoustic space causing interferences and acoustic delays, with the additional advantage of increasing the energy density of the waves which must travel over a longer path.

The public address system of the invention can thus include at least one second loudspeaker similar to the first and forming, at least with the first loudspeaker, a one-dimensional arrays of acoustic sources extending in a substantially transverse direction with respect to the first plane, which second loudspeaker comprises at least one first mobile flap that can move independently of the first mobile flap of the first loudspeaker.

"Second loudspeaker similar to the first" in this description means a second loudspeaker that may be strictly identical to the first loudspeaker but that can optionally have at least the features that, throughout this description, are explicitly attributed to the first loudspeaker in the description thereof.

"Substantially transverse direction with respect to the first plane" in this description means a direction that, without necessarily being strictly perpendicular to the first plane, makes a large angle with the latter, for example, of at least 70 degrees.

The public address system thus defined forms a one-dimensional array of acoustic sources, i.e. a system universally known to a person skilled in the art as a "Line Source Array".

The high-frequency sound section of each loudspeaker advantageously includes a wave guide connecting the transducer to the input of the expansion guide, wherein the wave guide can have, opposite the input of the expansion guide, an output in the form of a slot oriented in a substantially transverse direction with respect to the first plane.

To do this, the wave guide can be produced according to the teaching of the patent EP 0 331 566 or its American equivalent, U.S. Pat. No. 5,163,167.

In addition to the first flap, the expansion guide of each loudspeaker can also include a second mobile flap, which can also be moved by a movement made parallel to the first plane, in order to change the value of the solid transmission angle.

It should be ensured that the expansion guide of each loudspeaker is at least partially defined by walls extending in a substantially transverse direction with respect to the first plane and including two input walls extending from the input of this expansion guide and two output walls extending to the output of this expansion guide, that the input walls together form a first relatively closed angle, that the output walls are respectively connected to the input walls in the respective connection zones and together form a second relatively open angle, and that each mobile flap is arranged in the solid transmission angle at least partially inside the second angle, opposite a corresponding output wall, so as to selectively assume a position relatively close or relatively far with respect to said corresponding output wall.

Each loudspeaker is, for example, symmetrical with respect to a median plane perpendicular to the first plane, with the two input walls of the expansion guide of said loudspeaker being mutually symmetrical with respect to this median plane, and the two output walls of the same expansion guide also being mutually symmetrical with respect to this median plane.

In a preferred embodiment of the invention, each flap forms a non-zero angle with the corresponding output wall and is translatably mounted parallel to the first plane, between a position of relatively low directivity, in which the flap is relatively far from the connection zone of the corresponding output wall and in which the sound waves coming from the expansion guide are guided by the corresponding output wall, and a position of relatively high directivity, in which the flap is relatively close to the connection zone of the corresponding output wall or in contact therewith, and in which the sound waves coming from the expansion guide are guided by this flap.

Each flap in this case can have, in the connection zone, a leading edge assuming substantially the same orientation as the input wall to which the corresponding output wall is connected and in contact with this input wall in the position of relatively high directivity of the flap.

In practice, it is possible to ensure that the first angle is between 35 degrees and 55 degrees, preferably between 42 degrees and 48 degrees, that the second angle is between 100 degrees and 140 degrees, preferably between 115 degrees and 125 degrees, and that each flap forms, with the median plane, an angle between 20 degrees and 40 degrees, preferably between 25 degrees and 35 degrees.

Given that the values of the aforementioned angles can be precisely measured only when the flaps and walls are planar, and given that the flaps and the walls may very well not be planar, locally or generally, it is useful to specify that the aforementioned angle values are given in consideration of the general direction that each wall and each flap takes, so that the wall and the flap are seen at the scale of the wavelength corresponding to an average frequency, for example, of around 1300 Hz.

To produce a complete and relatively compact public address system according to the invention, it is possible to ensure that each loudspeaker comprises at least one first section for reproducing medium-frequency sounds placed against a first of the two input walls, outside the solid transmission angle and at least one first section for reproducing low-frequency sounds placed against a first of the two output walls, outside the solid transmission angle.

BRIEF DESCRIPTION OF THE DRAWINGS

Other features and advantages of the invention will become more clear from the description below, which is intended to be illustrative and non-limiting, in reference to the appended drawings, in which.

DETAILED DESCRIPTION OF THE PREFERRED EMBODIMENT(S)

As stated above, the invention relates to a public address system consisting of one or more loudspeakers E1 to E7.

Figure 1:
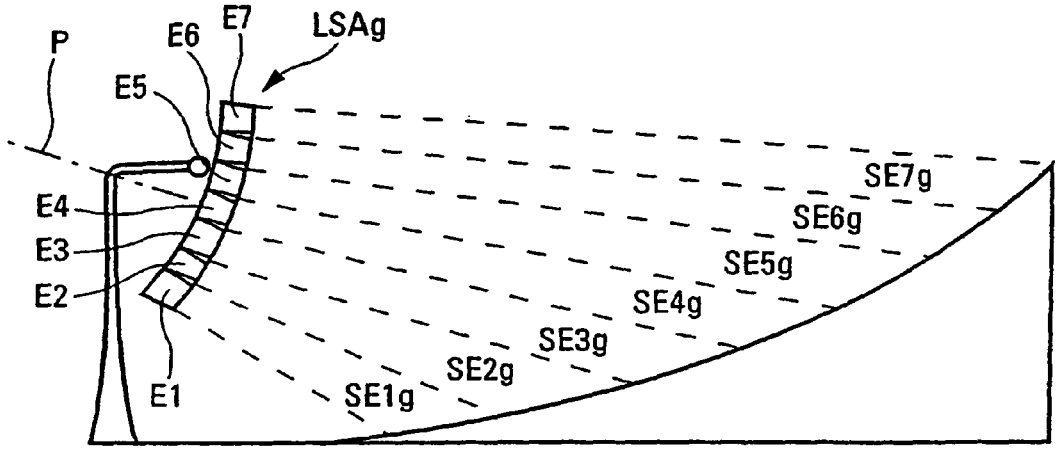
FIG. 1 is a vertical cross-section view of a space fitted with a public address system by means of a one-dimensional array of acoustic sources (Line Source Array) consistent or not with the invention.
Figure 2:
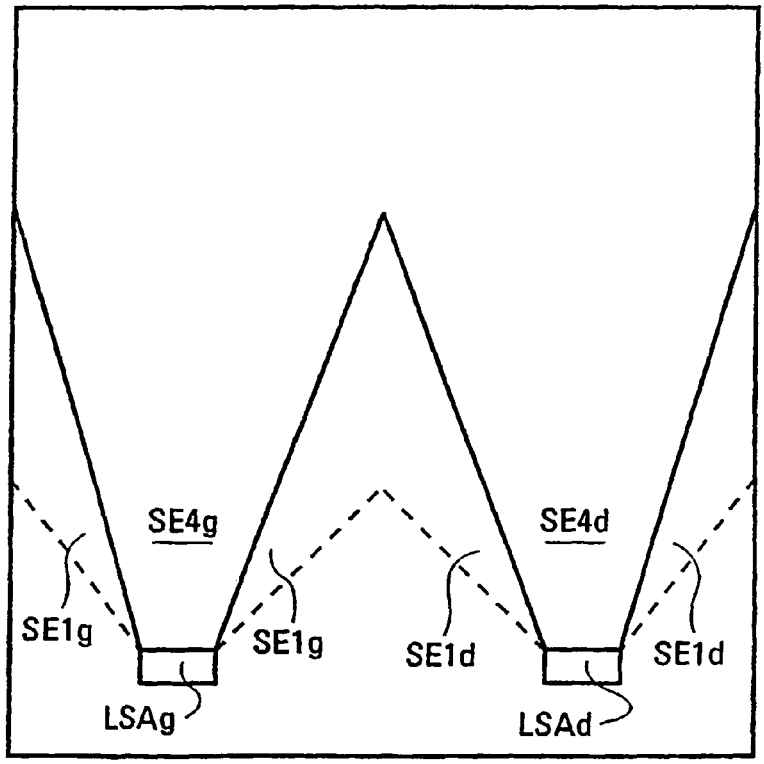
FIG. 2 is a plan view of a space fitted with a public address system by means of a one-dimensional array of acoustic sources (Line Source Array) consistent with the invention.

The most advantageous feature of the invention is shown in FIGS. 1 and 2, in which the system of the invention is shown in the form of a one-dimensional array of acoustic sources (Line Source Array), such as LSAg or LSAd, used in a public address system for a space shown in a vertical cross-section in FIG. 1.

Each of the loudspeakers E1 to E7 of each of the arrays LSAg and LSAd transmits a sound wave beam, such as SE1*g* to SE7*g* for array LSAg (FIG. 1) or such as SE1*d* and SE4*d* for the respective loudspeakers E1 and E4 of array LSAd (FIG. 2).

As is known, each array can, as shown in FIG. 1, consist of a slightly curved column formed by stacking loudspeakers E1 to E7, with the various sound beams SE1*g* to SE7*g* thus selectively transmitting to the closest listeners for loudspeaker E1 and the farthest listeners for loudspeaker E7.

In the case of known one-dimensional acoustic arrays, the solid transmission angle of the different beams such as SE1 to SE7 has the same angle of divergence for all of the beams, with the angle of divergence being, for example, defined as the angle of the line of each beam in the plane P substantially perpendicular to the direction in which the loudspeakers E1 to E7 are stacked.

Under these conditions, the need to give the beam SE1*g* a sufficient angle of divergence in order to best fit the hearing zone closest to the array LSAg with a public address system makes it necessary to give, for example, the beam SE7*g* an oversized angle of divergence, leading to the appearance of multiple acoustic delays of this beam due to reflection on the walls of the auditory space.

The invention, of which an effect is shown in FIG. 2, enables this problem to be solved by providing loudspeakers with adjustable directivity.

It is thus possible, as shown in FIG. 2, to give, for example, the beams SE1*g* and SE1*d*, a relatively large angle of divergence in order to best fit the hearing zone closest to the arrays LSAg and LSAd with a public address system, and to give other beams, for example beams SE4*g* and SE4*d*, a relatively small angle of divergence in order to best fit a hearing zone farther from the arrays LSAg and LSAd with a public address system, thus avoiding the multiple reflections on the walls of the auditory space, and correspondingly concentrating the energy of the sound waves of these other beams, for example SE4*g* and SE4*d*, which must travel over a longer path.

As is known (FIG. 3), each loudspeaker E1 is equipped with a section 11 for reproducing high-frequency sounds, i.e. sounds with a frequency typically of at least 1300 Hz.

This section 11 generally includes a transducer 20, such as a motor with a compression chamber, a wave guide 21, and a wave expansion guide 3, wherein the wave guide 21 is placed between the transducer 20 and the expansion guide 3.

This expansion guide 3 has an input 30 relatively close to the output 210 of the wave guide 21 and therefore to the transducer 20, and an output 31 relatively far from the output 210 of the wave guide 21 and therefore the transducer 20.

The expansion guide 3 receives, at its input 30, the sound waves coming from the transducer 20 and transmitted by the wave guide 21.

The guide 21 is, for example, produced according to patents EP 0 331 566 or U.S. Pat. No. 5,163,167, which are now universally known to a person skilled in the art, and has, opposite the input 30 of the expansion guide 3, and as an output 210, a slot oriented in a substantially transverse direction with respect to the plane P, which is constituted in particular by the plane of FIGS. 3, 4A, 4B and 7A to 7D.

The expansion guide 3 has, projecting in the same plane F, a form opening outwards from its input 30 to its output 31 in order to distribute, in a solid transmission angle, the sound waves coming from said expansion guide 3.

According to the invention, the expansion guide 3 of each loudspeaker E1 to E7 includes at least one mobile flap 32*g* and, for example, two mobile flaps 32*g* and 32*d*.

Each mobile flap 32*g* or 32*d* can be moved by a movement made parallel to the plane P, so that the solid transmission angle of the high and medium frequency sound waves has a value that can be adjusted by moving each flap 32*g* or 32*d*.

In the preferred embodiment of the invention, which is shown, the expansion guide 3 of each loudspeaker E1 to E7 is at least partially defined by walls 33*g*, 33*d*, 34*g*, and 34*d* (FIG. 3, in particular), which extend in a substantially transverse direction with respect to the plane P.

These walls more specifically include two input walls, 33*g* and 33*d*, which extend from the input 30 of the expansion guide 3, and two output walls, 34*g* and 34*d*, which extend to the output 31 of this expansion guide 3, with the output walls 34*g* and 34*d* respectively connecting to the input walls 33*g* and 33*d* in respective connection zones 35*g* and 35*d*.

The input walls 33*g* and 33*d* together form a relatively small angle A1, for example, between 35 degrees and 55 degrees, preferably between 42 degrees and 48 degrees, and which can be chosen to be 45 degrees.

The output walls 34*g* and 34*d* together form a relatively wide angle A2, for example, between 100 degrees and 140 degrees, preferably between 115 degrees and 125 degrees, and which can be chosen to be 120 degrees.

Figure 3:
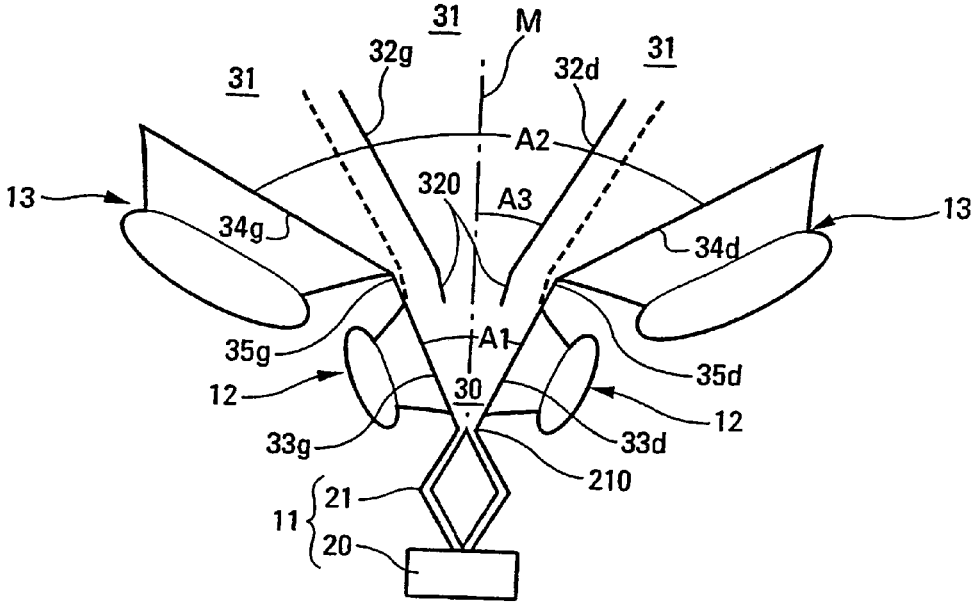
FIG. 3 is a schematic view, in the first plane P, of a public address system consisting of a single loudspeaker produced according to the invention.

As shown in particular in FIG. 3, each loudspeaker E1 to E7 can be symmetrical with respect to a median plane M perpendicular to the first plane P, so that the two input walls 33*g* and 33*d* of the expansion guide 3 of this loudspeaker are mutually symmetrical with respect to this median plane M, and the two output walls 34*g* and 34*d* of the same expansion guide 3 are also mutually symmetrical with respect to this median plane M.

Each mobile flap 32*g* or 32*d* is placed at least partially inside the second angle A2, opposite the left output wall 34*g* for the left flap 32*g*, and opposite the right output wall 34*d* for the right flap 32*d*, with each flap assuming, as desired, a position relatively close or relatively with respect to the corresponding output wall 34*g* or 34*d*.

For example, each mobile flap 32*g* or 32*d* permanently forms a non-zero angle with the corresponding output wall 34*g* or 34*d* and is translatably mounted parallel to the first plane P, between at least one position of relatively low directivity, in which this flap 32*g* or 32*d* is relatively far from the connection zone 35*g* or 35*d* of the corresponding output wall 34*g* or 34*d*, and a position of relatively high directivity, in which this flap 32*g* or 32*d* is relatively close to the connection zone 35*g* or 35*d* of the corresponding output wall 34*g* or 34*d*, or even in contact therewith.

Figure 4A:
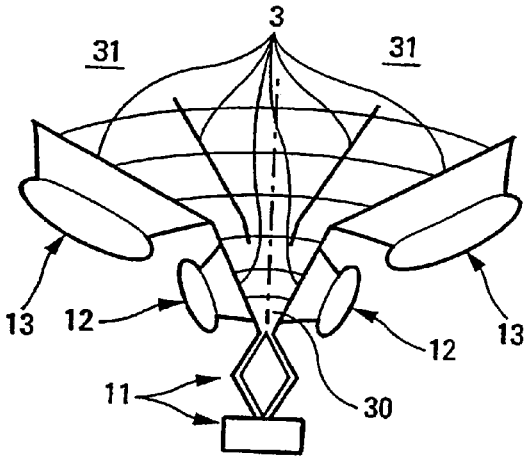
FIGS. 4A and 4B are views showing, on the smallest scale, the loudspeaker shown in FIG. 3, respectively in minimum and maximum directivity configurations.

When a flap, 32*g* or 32*d*, is placed in its position of relatively low directivity, shown with a solid line in FIG. 3, the sound waves coming from the expansion guide 3 are guided by the output wall 34*g* or 34*d* located on the same side as this flap, with this situation being symbolically shown in FIG. 4A for the two flaps simultaneously.

Figure 4B:
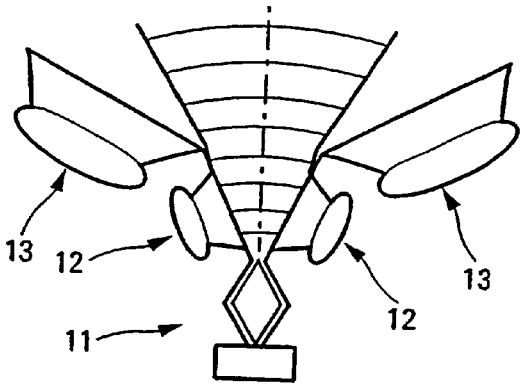

However, when a flap, 32*g* or 32*d*, is placed in its position of relatively high directivity, shown with a dotted line in FIG. 3, the sound waves coming from the expansion guide 3 are guided by this flap 32*g* or 32*d*, with this situation being symbolically shown in FIG. 4B for the two flaps simultaneously.

Each flap 32*g* or 32*d* is, for example, essentially planar and forms, with the median plane M, an angle A3 between 20 degrees and 40 degrees, preferably between 25 degrees and 35 degrees, and which can be chosen to be 30 degrees.

In addition, each flap 32*g* or 32*d*, for example, consisting of a polycarbonate plate, can have, in the corresponding connection zone 35*g* or 35*d*, a leading edge 320 (FIGS. 3 and 6) assuming substantially the same orientation as the input wall 33*g* or 33*d* located on the same side as this flap, and in contact with this input wall 33*g* or 33*d* in the position of relatively high directivity of this flap 32*g* or 32*d* (FIG. 4B).

Each loudspeaker E1 to E7 preferably comprises two sections 12 for reproducing medium-frequency sounds and two sections 13 for reproducing low-frequency sounds arranged outside the solid transmission angle of the sound waves and symmetrically with respect to the median plane M.

Each section 12 for reproducing medium-frequency sounds essentially consists, for example, of a loudspeaker mounted on a wooden panel forming at least a portion of the input wall, 33*g* or 33*d*.

Similarly, each section 13 for reproducing low-frequency sounds essentially consists, for example, of a loudspeaker mounted on a wooden panel forming at least a portion of the output wall, 34*g* or 34*d*.

Under these conditions, each input wall 33*g* or 33*d* can be considered to be physically formed both by the corresponding wooden panel and by the diaphragm of the corresponding medium-frequency loudspeaker, with the direction of this input wall being assimilar to that of the wooden panel.

Similarly, each output wall 34*g* or 34*d* can be considered to be physically formed both by the corresponding wooden panel and by the diaphragm of the corresponding low-frequency loudspeaker, with the direction of this output wall being assimilar to that of the wooden panel.

Figure 5A:
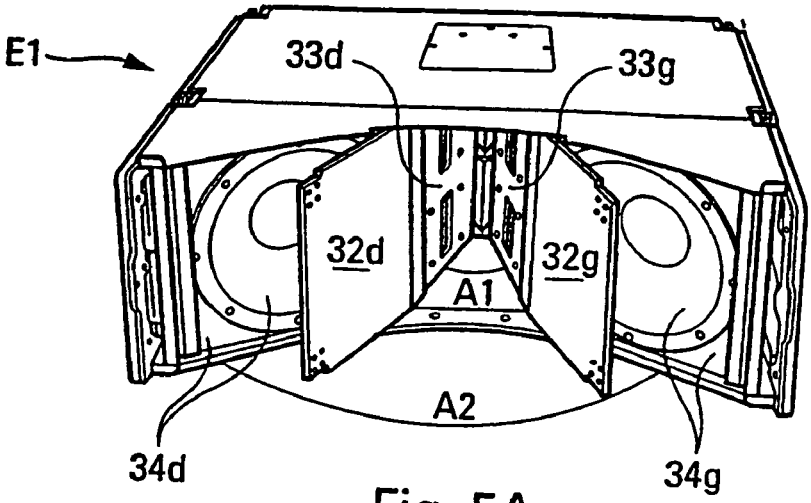
FIGS. 5A to 5D are perspective views of a public address system consisting of a single loudspeaker produced according to the invention and respectively shown in a maximum directivity configuration, a minimum directivity configuration, an asymmetrical directivity configuration, maximum at the right (in the figure) and minimum at the left, and an asymmetrical directivity configuration, minimum at the right (in the figure) and maximum at the left.
Figure 5B:
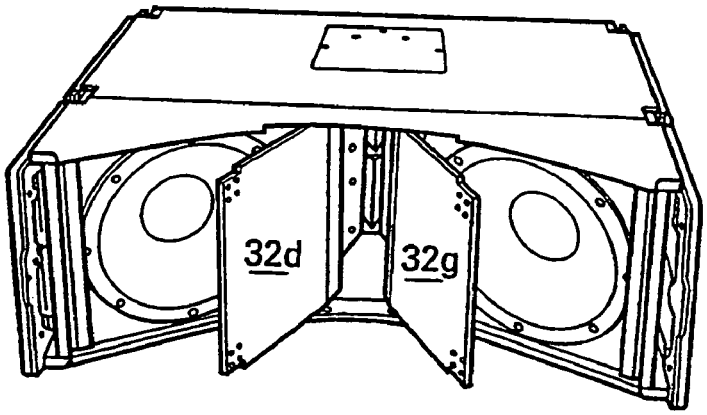
Figure 5C:
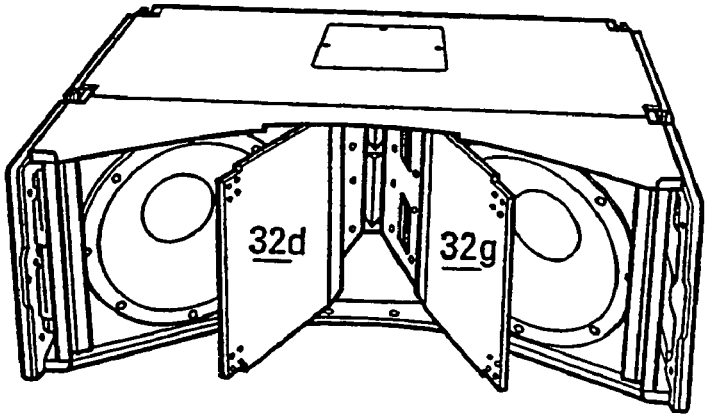
Figure 5D:
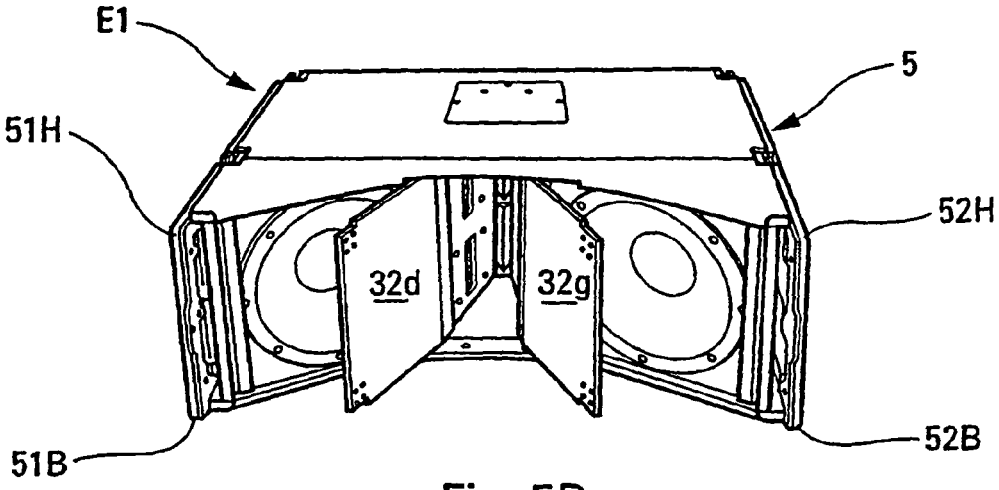
Figure 7A:
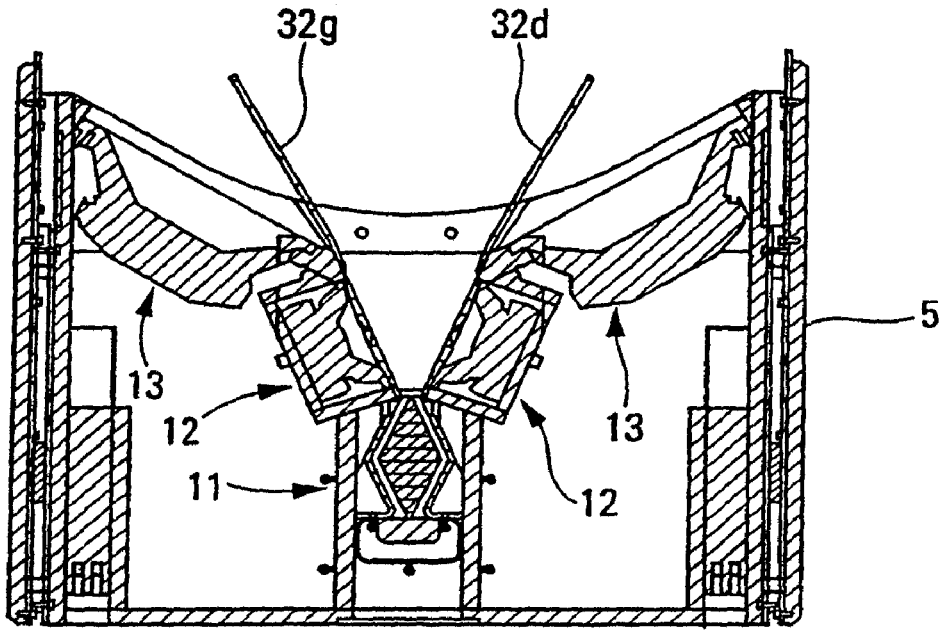
FIGS. 7A to 7D are cross-section views, in the most characteristic planes, of a public address system consisting of a single loudspeaker produced according to the invention and respectively shown in a maximum directivity configuration, a minimum directivity configuration, an asymmetrical directivity configuration, minimum at the right (in the figure) and maximum at the left, and an asymmetrical directivity configuration, maximum at the right (in the figure) and minimum at the left.
Figure 7B:
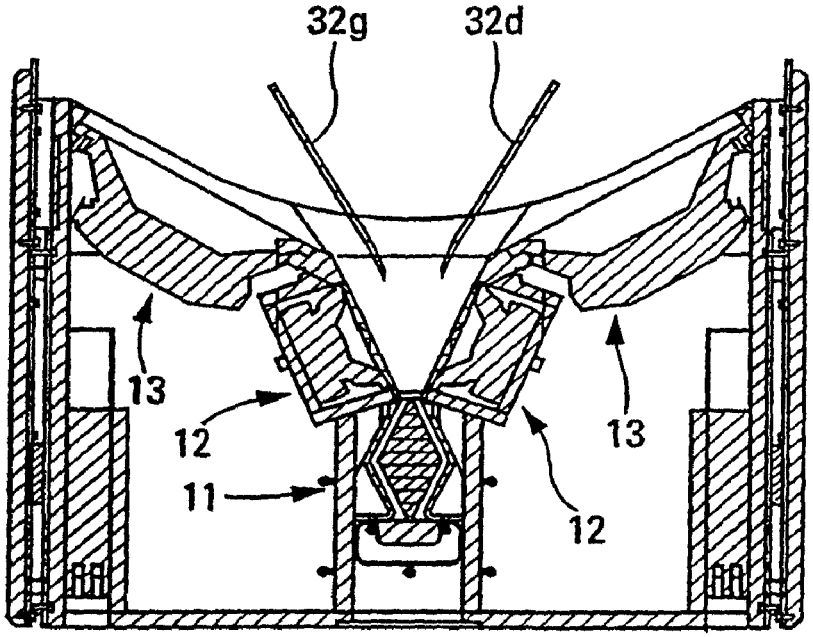
Figure 7C:
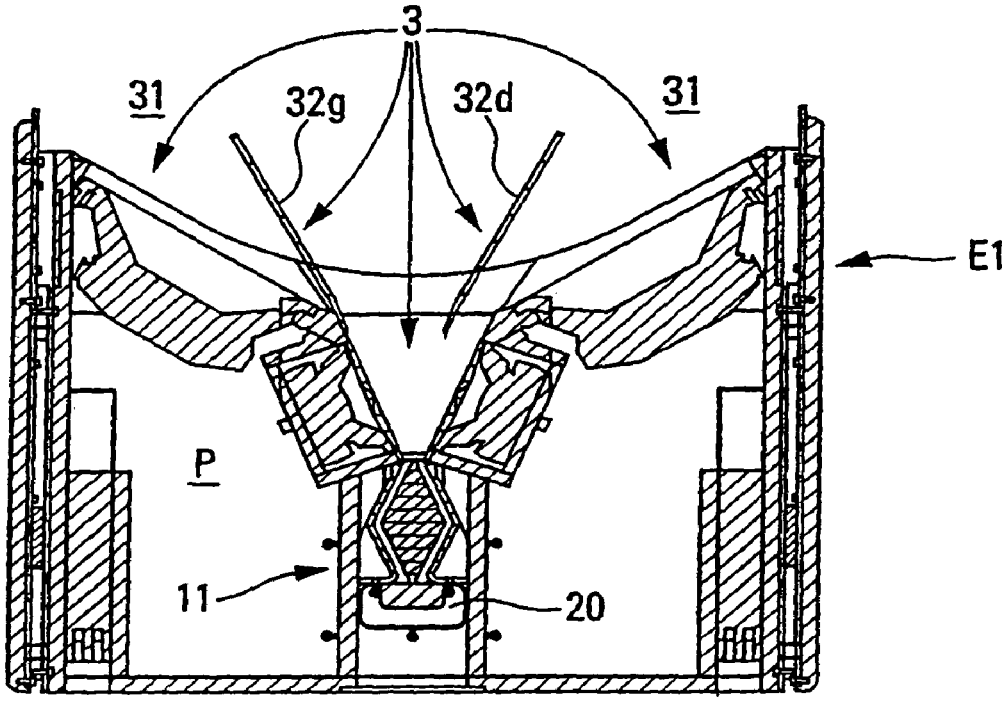
Figure 7D:
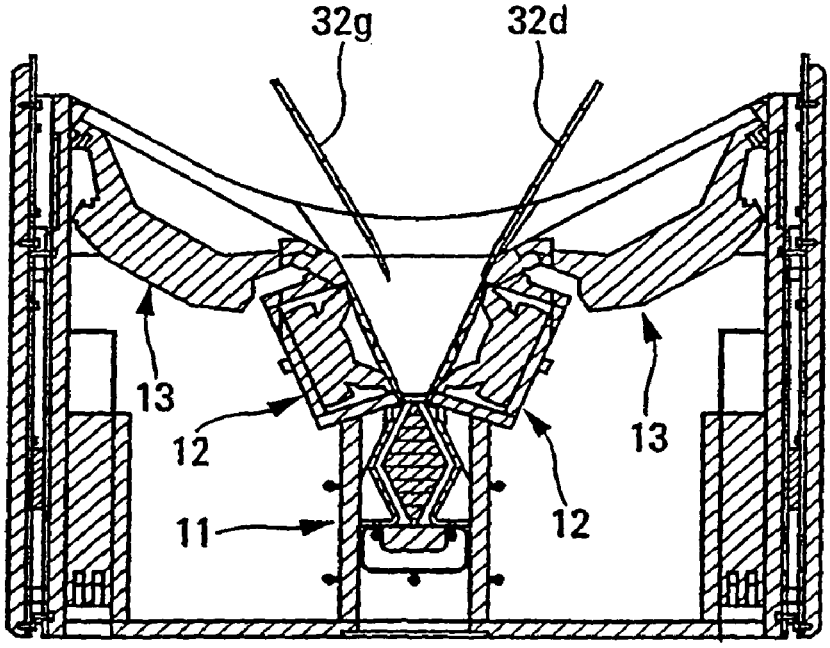

In the preferred case, in which the flaps 32*g* and 32*d* can move independently of one another, they can assume not only a symmetrical configuration of high directivity as shown in FIGS. 4B, 5A and 7A and a symmetrical configuration of low directivity as shown in FIGS. 3, 4A, 5B and 7B, but also a first asymmetrical configuration shown in FIGS. 5C and 7C in which flap 32*d* is in a position of low directivity while flap 32*g* is in a position of high directivity, and a second asymmetrical configuration shown in FIGS. 5D and 7D in which flap 32*g* is in a position of low directivity while flap 32*d* is in a position of high directivity.

Figure 6:
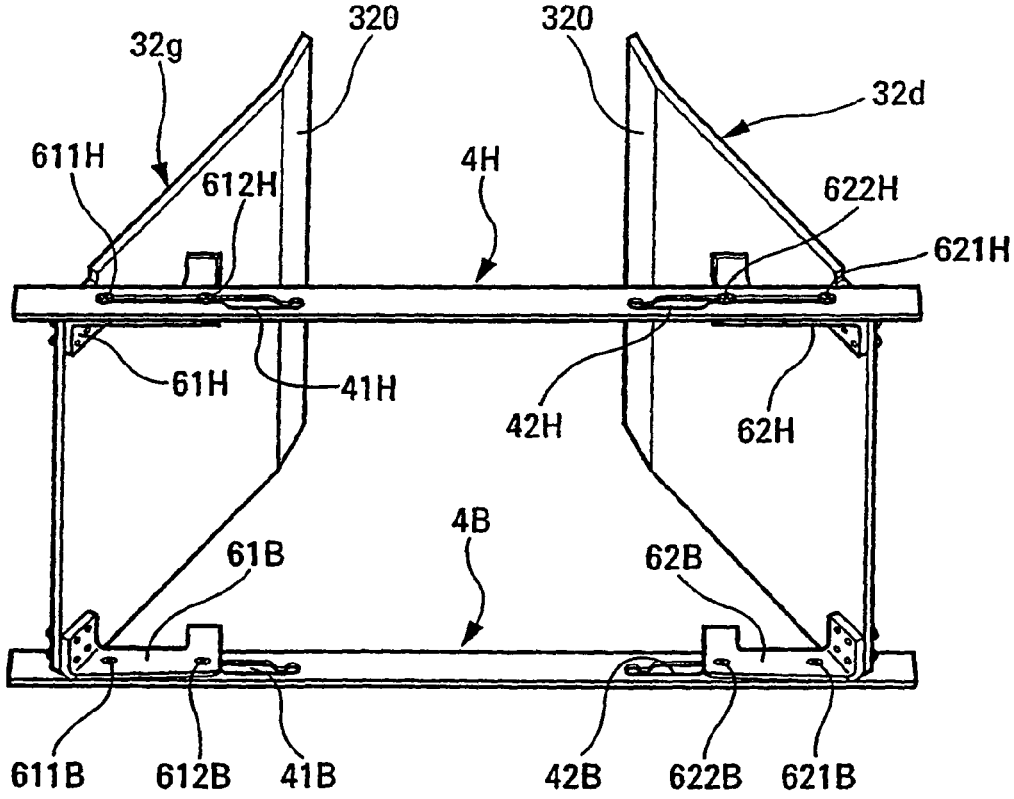
FIG. 6 is a perspective view of an example of a device for mounting and adjusting flaps of a public address system consisting of a single loudspeaker produced according to the invention.

FIG. 6 shows a mechanism that can be used, inter alia, to hold the flaps 32*g* and 32*d* and to enable their movement between positions of low and high directivity.

Such a mechanism includes, for example, two mutually parallel slide fittings 4H and 4B, with slide fitting 4H being attached by its ends to the upper front edges 51H and 52H (FIG. 5D) of the shell or the frame 5 of the loudspeaker E1, and slide fitting 4B being attached by its ends to the lower front edges 51B and 52B (FIG. 5D) of this shell or this frame 5.

Each flap, 32*g* and 32*d*, is also equipped, on its upper and lower edges, with respective slides, 61H, 61B, 62H, 62B, rigidly attached to the flap and holding it in a predetermined angular position with respect to the plane passing through the slide fittings.

Each of the slides, 61H, 61B, 62H, 62B, also comprises two lugs, 611H, 612H, 611B, 612B, 621H, 621B, and 622B, aligned with the length of the slide fittings 4H and 4B.

These lugs are engaged and locked in the respective slots, 41H, 41B, 42H, 42B, which are formed in the slide fittings 4H and 4B, and in which the lugs are mounted so as to slide between two extreme positions.

The invention claimed is:

1. Public address system comprising at least one first loudspeaker at least equipped with one high-frequency sound section for reproducing high-frequency sounds, with one medium-frequency sound section for reproducing medium-frequency sounds, and with a wave expansion guide, said expansion guide comprising an input receiving sound waves coming from a transducer of the high-frequency sound section, and an output in which the sound waves in said expansion guide are distributed in a solid transmission angle, said expansion guide further comprising two input walls, two output walls, and two mobile flaps, the input walls extending in a substantially transverse direction with respect to a first plane, being symmetrical with respect to a median plane perpendicular to the first plane, and mutually forming a first angle, the output walls being respectively connected to the input walls in respective connection zones, forming together a second angle wider than the first angle, and being symmetrical with respect to the median plane, the expansion guide having at least projecting in said first plane, a form opening outwards from said input to said output, and the mobile flaps being moveable by a movement parallel to said first plane, whereby a solid transmission angle is set by moving said mobile flaps, wherein said at least one first loudspeaker comprises two medium-frequency sound sections respectively placed against the two input walls, outside the solid transmission angle, wherein each mobile flap is arranged at least partially inside the second angle, opposite a corresponding output wall, and has a leading edge remote from the output of the expansion guide, and wherein the leading edge of each mobile flap in a first position is spaced from the respective connection zone and is moveable with respect to the respective connection zone, whereby each mobile flap selectively assumes, independently of the other flap, a relatively close or a relatively far position with respect to said corresponding output wall.

2. Public address system according to claim 1, wherein said at least one first loudspeaker comprises at least one low-frequency sound section for reproducing low-frequency sounds, and said low-frequency sound section being placed against a first of the two output walls, outside said solid transmission angle.

3. Public address system according to claim 2, wherein said at least one first loudspeaker comprises two low-frequency sound sections respectively placed against the two output walls, outside said solid transmission angle.

4. Public address system according to claim 1, wherein said high-frequency sound section includes a wave guide connecting the transducer to the input of the expansion guide.

5. Public address system according to claim 4, wherein the wave guide has, opposite the input of the expansion guide, an output in the form of a slot oriented in a substantially transverse direction with respect to the first plane.

6. Public address system according to claim 1, wherein each flap forms a non-zero angle with the corresponding output wall and is moveable, by a translation parallel to the first plane, between a position of relatively low directivity, in which the leading edge of said flap is relatively far from the connection zone of the corresponding output wall and in which the sound waves coming from the expansion guide are guided by the corresponding output wall, and a position of relatively high directivity, in which the leading edge of said flap is relatively close to the connection zone of the corresponding output wall or in contact therewith, and in which the sound waves coming from the expansion guide are guided by said flap.

7. Public address system according to claim 6, wherein the leading edge of each flap substantially assumes, in the connection zone, the same orientation as the input wall to which the corresponding output wall is connected, and is in contact with said input wall in the position of relatively high directivity of the flap.

8. Public address system according to claim 1, wherein the first angle is between 35 degrees and 55 degrees, wherein the second angle is between 100 degrees and 140 degrees, and wherein each flap forms, with the median plane, an angle between 20 degrees and 40 degrees.

9. Public address system according to claim 1, wherein the first angle is between 42 degrees and 48 degrees, wherein the second angle is between 115 degrees and 125 degrees, and wherein each flap forms, with the median plane, an angle between 25 degrees and 35 degrees.

10. Public address system according to claim 1, further including at least one second loudspeaker similar to the first loudspeaker and forming, at least with the first loudspeaker, a one-dimensional acoustic source array extending in a substantially transverse direction with respect to the first plane, wherein the second loudspeaker comprises two mobile flaps that can move independently of the mobile flaps of the first loudspeaker.

* * * * *